United States Patent [19]

Fischer

[11] 4,189,863

[45] Feb. 26, 1980

[54] HOLLOW STRUCTURAL ELEMENT AND AN ASSEMBLY KIT INCLUDING THE SAME

[76] Inventor: Artur Fischer, Weinhalde 34, D-7244 Waldachtal 3 (Tumlingen), Fed. Rep. of Germany

[21] Appl. No.: 849,413

[22] Filed: Nov. 7, 1977

[30] Foreign Application Priority Data

Nov. 6, 1976 [DE] Fed. Rep. of Germany ... 7635178[U]

[51] Int. Cl.[2] ..... A63H 13/00

[52] U.S. Cl. ..... 46/116; 46/17; 46/101

[58] Field of Search ..... 46/17, 97, 98, 99, 101, 46/106, 116, 201, 202, 16, 22

[56] References Cited

U.S. PATENT DOCUMENTS

| | | | |
|---|---|---|---|
| 2,175,845 | 10/1939 | Lohr | 46/101 |
| 3,653,152 | 4/1972 | Levine | 46/116 |
| 4,019,276 | 4/1977 | Nakao | 46/99 |

*Primary Examiner*—Louis G. Mancene
*Assistant Examiner*—Paul J. Hirsch
*Attorney, Agent, or Firm*—Michael J. Striker

[57] ABSTRACT

A hollow structural element of an assembly kit, particularly forming a compartment of a toy vehicle has a hollow body having an open end through which a toy figure can be inserted, a wall located opposite to the open end and provided with connecting elements for connecting the body portion with another structural element, and side walls having a plurality of projections adapted to engage a toy figure and to retain the latter in the body portion. The toy figure may have a base portion and an undercut portion, and the projections of the side walls of the body portion may be so located as to engage the undercut portion of the toy model. The projections of the side walls of the body portion may extend parallel to the opposite wall and outside of corner regions of the body portion. Connecting elements of the other structural element may extend inwardly of the body portion, and the projections of the side walls may be so located that the base portion of the toy model abuts against the connecting elements of the other structural element in assembled condition.

10 Claims, 2 Drawing Figures

HOLLOW STRUCTURAL ELEMENT AND AN ASSEMBLY KIT INCLUDING THE SAME

BACKGROUND OF THE INVENTION

The present invention relates to a hollow structural element and to an assembly kit including the hollow structural element.

Children in the 2 and 3 year age group generally find it difficult to assemble toy models and particularly vehicle toy models even when such models are comprised of very simple structural elements. In order to provide for children a possibility to play, on the one hand, and a possibility to disassemble the structural elements it has been found advisable to assemble the structural elements into toy models directly by a manufacturer and to offer them for sale in an assembled condition. However, this has the disadvantage that additional elements which are not connected with the toy models, such as toy figures insertable into compartments of toy vehicle models, fall in confusion in packing cases during transport. In order to avoid this disadvantage, additional securing means must be provided at predetermined locations of the packaging, which makes the latter more expensive.

SUMMARY OF THE INVENTION

Accordingly, it is an object of the present invention to provide a hollow structural element and an assembly kit including the hollow structural element which avoid the disadvantages of the prior art.

More particularly, it is an object of the present invention to provide a hollow structural element and an assembly kit which gives a possibility for additional parts to be connected with the hollow structural element without the aid of additional securing means.

Another object of the present invention is to provide such a hollow structural element with which additional parts can be easily and conveniently connected so as to form a reliable connection of the latter.

In keeping with these objects, and with others which will become apparent hereinafter, one feature of the present invention resides, briefly stated, in a hollow structural element of an assembly kit comprising a hollow body portion forming a compartment of a toy vehicle and having an open end through which a toy figure can be inserted, a wall opposite to the open end and provided with means for connecting the body portion with another structural element, and side walls having a plurality of projections adapted to engage the toy figure when the latter is inserted in the body portion and to retain the toy figure in the body portion.

In the thus-constructed hollow structural element additional parts such as the toy figures may be reliably connected therewith for instance during transport so that they will not fall in loose in packing cases, and at the same time the additional parts may thereafter be easily disconnected by a playing child. No additional means are necessary for securing the additional parts.

Another feature of the present invention is that the projections of the side walls of the body portion of the structural hollow element are located outside corner regions of the body portion. When the projections are so formed that they are located outside substantially rigid corner portions of the side walls a very small force suffices for engaging the toy figure with the projections of the body portion or disengaging the toy figure therefrom so that a two-year old child can easily perform these operations.

Still another feature of the present invention is that the wall opposite to the open end of the body portion may be provided with an opening through which a connecting portion of another structural element or an axel of the toy vehicle to be assembled can be inserted. In this case, the hollow structural element can be connected with other parts of the assembly kit. Preferably, the opening is formed as an undercut opening.

A further feature of the present invention is that the projections of the body portion are so located that the base portion of the toy figure inserted into the body portion and engaged by the projections thereof rests on the connecting portion of the structural element or the axle when the latter extends through the opening of the opposite wall and into the interior of the body portion.

A still further feature of the present invention is that for facilitating the insertion of the toy model into the body portion, edges of the base portion of the toy figure are rounded, and the toy figure has an undercut portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
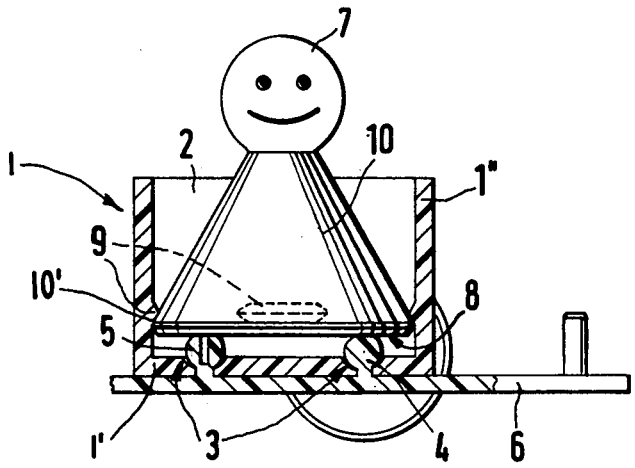
FIG. 1 is a side section showing a hollow structural element connected with another structural element and with a toy figure inserted in the former, so as to form a toy vehicle model.
Figure 2:
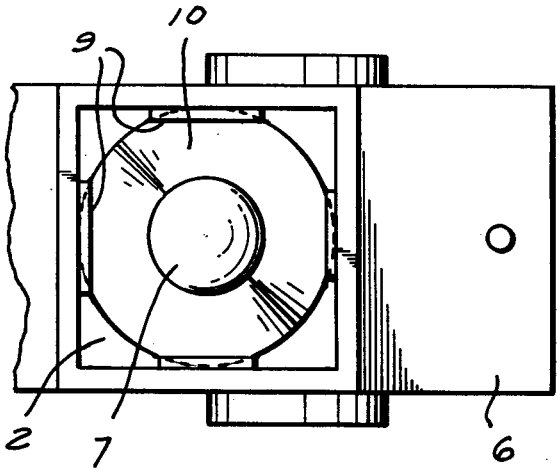
FIG. 2 is a plan view of the elements shown in FIG. 1.

As shown in the drawing, a hollow structural element forms a compartment of a toy vehicle model.

The hollow structural element has a body portion identified in toto by reference numeral 1. The body portion 1 has an open end 2 and includes a bottom wall 1' located opposite to the open end 2. Two slot-like openings are provided in the wall 1' and are enlarged towards the interior of the body portion 1. An axle 4 of the toy vehicle is inserted in one of the openings 3, and a connecting projection 5 of a base plate 6 forming a chassis of the toy vehicle is inserted in the other opening 3. It can be seen that the axle 4 as well as the connecting projection 5 of the base plate 6, extend inwardly beyond the bottom wall 1' of the body portion 1 of the hollow structural element.

The body portion 1 is further provided with projections 9 which are formed on side walls 1'' thereof. It can be seen from the drawing that the body portion 1 has four such side walls 1'' and that each of the side walls is provided with one such projection 9. However, it is to be understood that the body portion 1 may have a different number of side walls, and that a different number of projections may be formed on the latter. The projections 9, not located in the corner regions of the body portion 1, extend substantially parallel to the bottom wall 1'.

A toy figure 7 is inserted in the body portion 1 of the hollow structural element. The toy figure 7 has a base portion 8 which is circular and has rounded marginal edges. The toy figure 7 has a supporting portion 10 which is conical and has an upwardly reduced cross-section. When the toy figure 7 is inserted into the body portion 1 by movement in a downward direction, a lower section 10' of the conical supporting portion 10 passes by the projections 9 and thereafter the projections engage the section 10' of the supporting portion 10 and retains the toy figure 7 in the body portion 1 of the hollow structural element. Thus, the conical supporting portion 10 serves as an undercut formation of the toy model 7.

As can be seen in FIG. 1, when the toy Figure 7 is fully inserted in the body portion 1 of the hollow structural element and engaged by the projections 9 of the latter, the base portion 8 of the toy model 7 rests on the axle 5 and the connecting projection 4 of the base plate 6. In order to provide such a relationship the projections 9 of the body portion 1 are located at a height, relative to the bottom wall 1', which is substantially equal to the height of the lower section 10' located downwardly beyond the projections 9 plus the height of the axle 4 or the connecting projection 5. It is known that in order to facilitate removal of hollow parts produced by an injection molding process from a mold, a die forming a hollow of the hollow part is provided with indentations which form projections on inner faces of the hollow parts. It is possible to so construct and locate these indentations that they will form the projections which can be used for the proposed mounting of the toy figure in the hollow structural element.

It will be understood that each of the elements described above, or two or more together, may also find a useful application in other types of constructions differing from the types described above.

While the invention has been illustrated and described as embodied in a hollow structural element and an assembly kit including the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toy assembly kit, comprising a hollow structural element forming a compartment and having a hollow body portion, said hollow body portion having an open end, a wall located opposite to said open end and provided with an opening, and side walls each having a projection; a toy figure insertable into said body portion through said open end and having a lower section adapted to be located inwardly beyond said projections of said body portion and to be engaged by said projections in inserted condition, so that said toy figure is retained in said body portion of said structural element, said lower section of said toy figure having a predetermined height; and another structural element having a connecting projection adapted to pass through said opening of said opposite wall of said body portion and to extend inwardly beyond said opposite wall by a predetermined height, so that said other structural element is connected with said hollow structural element, said projections of said side wall being spaced from said opposite wall of said body portion for a distance substantially equal to said predetermined height of said lower section of said toy figure plus said predetermined height for which said connecting projection of said other structural element extends inwardly beyond said opposite wall, so that said toy figure in the inserted condition abuts against said connecting projection of said other structural element when the latter is connected with said body portion.

2. A kit as defined in claim 1; further including an axle of a toy vehicle, said opposite wall including a further opening for receiving said axle of the toy vehicle.

3. A kit as defined in claim 1, wherein said toy figure has a base portion.

4. A kit as defined in claim 3, wherein said base portion of said toy figure is circular.

5. A kit as defined in claim 3, wherein said base portion of said toy figure has rounded marginal edges.

6. A kit as defined in claim 1, wherein each of said side walls of said body portion of said structural element has an inner face, said projections being arranged on said inner faces of said side walls.

7. A kit as defined in claim 6, wherein said body portion of said structural element has corner regions each defined between two adjacent side walls, said projections being formed outside said corner regions.

8. A kit as defined in claim 1, wherein said opposite wall of said body portion has a face, said projections extending parallel to said face of said opposite wall.

9. A kit as defined in claim 1, wherein said body portion of said structural element has four such side walls.

10. A kit as defined in claim 1, wherein said lower section of said toy figure is undercut.

* * * * *